US006196338B1

(12) United States Patent
Slaughter et al.

(10) Patent No.: US 6,196,338 B1
(45) Date of Patent: Mar. 6, 2001

(54) HARDFACING ROCK BIT CONES FOR EROSION PROTECTION

(75) Inventors: Robert Slaughter; Roger Didericksen, both of Ponca City, OK (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/235,257

(22) Filed: Jan. 22, 1999

Related U.S. Application Data

(60) Provisional application No. 60/072,276, filed on Jan. 23, 1998.

(51) Int. Cl.[7] ..... E21B 10/46

(52) U.S. Cl. ..... 175/331; 175/374; 175/425

(58) Field of Search ..... 175/425, 374, 175/331

(56) References Cited

U.S. PATENT DOCUMENTS

| | | | | |
|---|---|---|---|---|
| 3,461,983 | | 8/1969 | Hudson et al. | 175/375 |
| 3,513,728 | | 5/1970 | Hudson et al. | 76/108.1 |
| 3,800,891 | * | 4/1974 | White et al. | 175/374 |
| 3,922,038 | * | 11/1975 | Scales | 384/95 |
| 3,952,815 | | 4/1976 | Dysart | 175/374 |
| 4,298,783 | | 11/1981 | Schneider et al. | 219/75 |
| 4,396,077 | * | 8/1983 | Radtke | 175/329 |
| 4,660,444 | * | 4/1987 | Sorensen et al. | 76/108.2 |
| 4,743,515 | | 5/1988 | Fischer et al. | 428/698 |
| 4,793,719 | | 12/1988 | Crockett et al. | 384/92 |
| 4,820,482 | | 4/1989 | Fischer et al. | 419/15 |
| 4,829,153 | | 5/1989 | Correy | 219/130.4 |
| 4,944,774 | * | 7/1990 | Keshavan et al. | 51/309 |
| 5,279,374 | * | 1/1994 | Sievers et al. | 175/374 |
| 5,291,807 | | 3/1994 | Vanderford et al. | 76/108.2 |
| 5,348,770 | | 9/1994 | Sievers et al. | 427/422 |
| 5,429,200 | * | 7/1995 | Blackman et al. | 175/371 |
| 5,452,771 | * | 9/1995 | Blackman et al. | 175/353 |
| 5,518,077 | * | 5/1996 | Blackman et al. | 175/353 |
| 5,535,838 | | 7/1996 | Keshavan et al. | 175/374 |
| 5,570,750 | * | 11/1996 | Blackman et al. | 175/371 |
| 5,644,956 | * | 7/1997 | Blackman et al. | 76/108.2 |
| 5,653,299 | * | 8/1997 | Sreshta et al. | 175/374 |
| 5,755,298 | * | 5/1998 | Langford, Jr. et al. | 175/374 |
| 5,921,330 | * | 7/1999 | Sue et al. | 175/374 |

OTHER PUBLICATIONS

Saltzman et al., "New Antiwear Coatings Applied by Plasma–Transferred Arc Wearsurfacing," Metallurgical Industries Inc., 39th Annual Meeting of ASLE, Chicago, Illnois, May 7–10, 1954.

Antony et al., "Hard Facing, A lesson from Metallurgy of Welding and Joining", MEI Materials Engineering Institute, Course 37, Lesson, Test 15, copyright 1978.

"Surface Engineering of Irons and Steels", ASM Handbook vol. 5, "Surface Engineering", pp. 690–691, undated.

"Gas Tungsten Arc Welding (TIG Welding)", Metals Handbook 9th edition; vol. 6, Welding, Brazing and Soldering, undated.

* cited by examiner

*Primary Examiner*—David Bagnell
*Assistant Examiner*—Jennifer Dougherty
(74) *Attorney, Agent, or Firm*—Rosenthal & Osha L.L.P.

(57) ABSTRACT

A method of manufacturing a rolling cone with hard-facing coating for use in drilling boreholes is disclosed. The method includes a step of depositing a layer of hardfacing material by an arc process, e.g., a gas-shielding tungsten arc welding process, a plasma-transferred arc welding process, or a metal inert gas arc welding process, over areas susceptible to erosion on the rolling cone surface. A rolling cone rock bit for drilling boreholes with a layer of hardfacing material deposited by an arc process either on the lands or in grooves or both of the cone surface is provided. Furthermore, a cone for attachment to the bit body of a rock bit with a layer of hardfacing material deposited on selected lands or in selected grooves or both of the cone surface also is provided.

28 Claims, 9 Drawing Sheets

160X 3D99 TIG

HARDFACING ROCK BIT CONES FOR EROSION PROTECTION

This application claims priority from U.S. Provisional Application Ser. No. 60/072,276 filed on Jan. 23, 1998.

FIELD OF INVENTION

The invention relates to drilling bits and more particularly to wear protection for rock bit cones.

BACKGROUND

Drilling in the earth is commonly accomplished by using a drill bit having a plurality of rock bit rolling cones ("cutter cones") that are set at angles, through earth formations. The bit essentially crushes the formations through which it drills. The rolling cones rotate on their axes and are, in turn, rotated about the main axis of the drill string. In drilling boreholes for oil and gas wells, blast holes, and raise holes, rock bit rolling cones constantly operate in a highly abrasive environment. This abrasive condition exists during drilling operations even with the use of a medium for cooling, circulating, and flushing the borehole. Such a cooling medium may be either drilling mud, air, or another liquid or gas .

When drilling a hard formation, a bit with tungsten carbide inserts projecting from the body of a rolling cone generally is utilized due to the inserts' relative hardness. However, the carbide inserts are mounted in a relatively soft metal (e.g. steel) that forms the body of the rolling cone. This relatively soft body may be abraded or eroded away when subjected to the high abrasive drilling environment. This abrasion or erosion occurs primarily due to the presence of relatively fine cuttings and chips from the formation that are in the borehole. Additional causes include the direct blasting effect of the drilling fluid utilized in the drilling process, and the rolling or sliding contact of the cone body with the formation. When the material supporting the inserts is substantially eroded or abraded away, the drilling forces either may break the inserts or may force them out of the rolling cone body. As a result, the bit is no longer effective in cutting the formation. Moreover, the inserts that break off from the rolling cone may further damage other inserts, the rolling cones, or other parts of the bit, eventually leading to a catastrophic failure.

Erosion of the rolling cone body usually is most pronounced on the inner and outer edges of the lands of the cone surface. This area is immediately adjacent to the insert and the groove between two rows of inserts. The heaviest wear on the rolling cone surface lands is usually on the inner edges of the outer rows and on the outer edges of the inner rows. When drilling relatively soft but abrasive formations, the bit is able to penetrate at an extremely high rate. This can result in individual cutting inserts penetrating entirely into the abrasive formation causing the formation to come into contact with the cone shell body. When such abrasive contact occurs, the relatively soft cone shell material will wear away at the edges of the surface lands until the interior portion of the insert becomes exposed. The retention ability of the cone body is reduced, thereby ultimately resulting in the potential loss of the insert and reduction of bit life. Because the penetration rate is related to the condition of the bit, the drill bit life and efficiency are of paramount importance in the drilling of boreholes. Accordingly, various methods of hardfacing rock bit cones for erosion or abrasion protection have been attempted. For example, thermal spraying has been used to coat the entire exposed surfaces, including the inserts, of a rolling cone with a hardfacing material. Another method involved placing small, flat-top compacts of hard material in the vulnerable cutter shell areas to prevent cone erosion. Since erosion of groove surface can be the main cause of insert loss due to erosion, methods were developed to apply hardfacing material to both the lands and the grooves of a rolling cone.

It should be noted that inserts are typically retained in a rolling cone by the "hoop" tension generated when the insert is press-fitted into a drilled hole in the rolling cone body. Accordingly, any method to alleviate the erosion of the rolling cone must take into consideration that the "hoop" tension holding the insert must be retained. It has been found undesirable to press the inserts into the cutter before applying hardfacing material. This is because the utilization of heat to adhere the hardfacing material to the surface of the rolling cone relieves the stresses (e.g., "hoop" tension) in the rolling cone. Therefore, it is more desirable to apply hardfacing material to both the lands and grooves of a rolling cone surface for erosion protection before the insert holes are drilled.

For the foregoing reasons, there exists a need for an effective yet economic method of applying hardfacing material to rolling cone surfaces for effective erosion protection. To reduce the cost of manufacturing such rock bits with hardfacing material, it is desirable that the method not be complicated and tedious. Further, the hardfacing material should be applied to the rolling cone surfaces before the insert holes are drilled.

SUMMARY OF INVENTION

In some aspects the invention relates to a method of manufacturing a cone, comprising providing a cone with a surface, a section of such surface being susceptible to erosion of the cone material, depositing a layer of hardfacing material on the erosion-susceptible section of the surface of the cone, heat treating the cone, drilling sockets into the cone, and pressing inserts into the sockets of the cone.

In an alternative embodiment, the invention relates to a cone for attachment to a rock bit comprising a generally conical body with a surface, a section of such surface being susceptible to erosion of the cone material, means for protecting the erosion-susceptible section of the surface with a hardfacing material, a plurality of sockets that are drilled into the body, and an insert that is held in each of the plurality of sockets.

In an alternative embodiment, the invention relates to a cone for attachment to a rock bit comprising a generally conical body with a surface, a section of such surface being susceptible to erosion of the cone material, a layer of hardfacing material that is deposited on the erosion-susceptible section of the surface, a plurality of sockets that are drilled into the body, and an insert that is held in each of the plurality of sockets.

DETAILED DESCRIPTION

Figure 1:
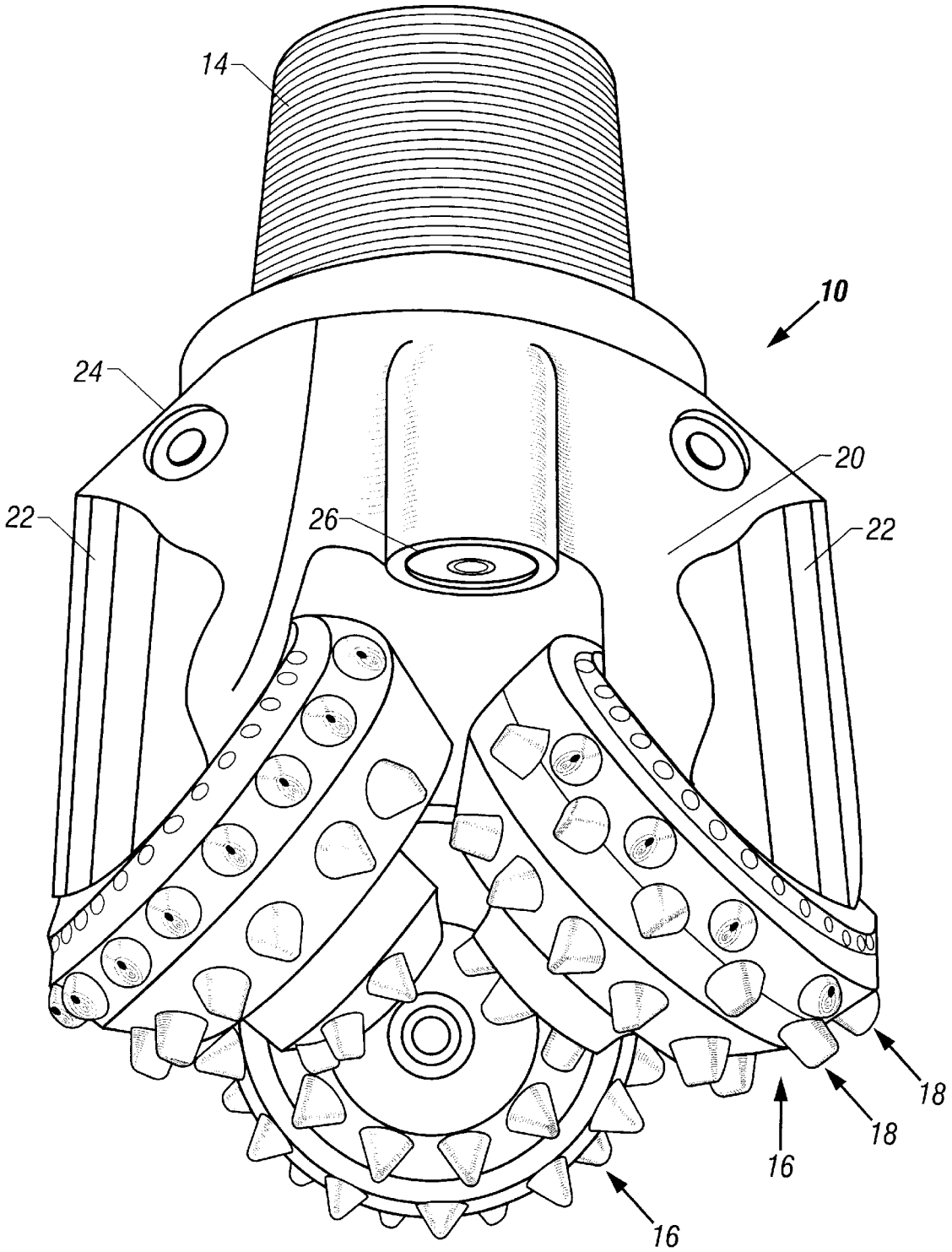
FIG. 1 (Prior Art)
FIG. 1 is a perspective view of a prior art three-cone rock bit.

Exemplary embodiments of the invention will be described with reference to the accompanying drawings. Like items in the drawings are shown with the same reference numbers.

Embodiments of the invention provide a hardfacing coating that exhibits good erosion resistance and possesses strong metallurgical bonding with a rolling cone surface. The hardfacing coating is applied by an arc process. Additionally, it is simple to implement and cost-effective.

FIG. 1 illustrates a typical prior art rock bit for drilling boreholes. The rock bit 10 has a steel body 20 with threads 14 formed at an upper end and three legs 22 at a lower end. Each of the three rolling cones 16 are rotatably mounted on a leg 22 at the lower end of the body 20. A plurality of cemented tungsten carbide inserts 18 are pressfitted or interference fitted into insert sockets formed in the cones 16. Lubricant is provided to the journals 19 (shown in FIG. 2) on which the cones are mounted from grease reservoirs 24 in the body 20. This configuration generally is used for seal bearing rock bits. For petroleum and mining applications with open bearing rock bits, there typically are no grease reservoirs 24.

Figure 2:
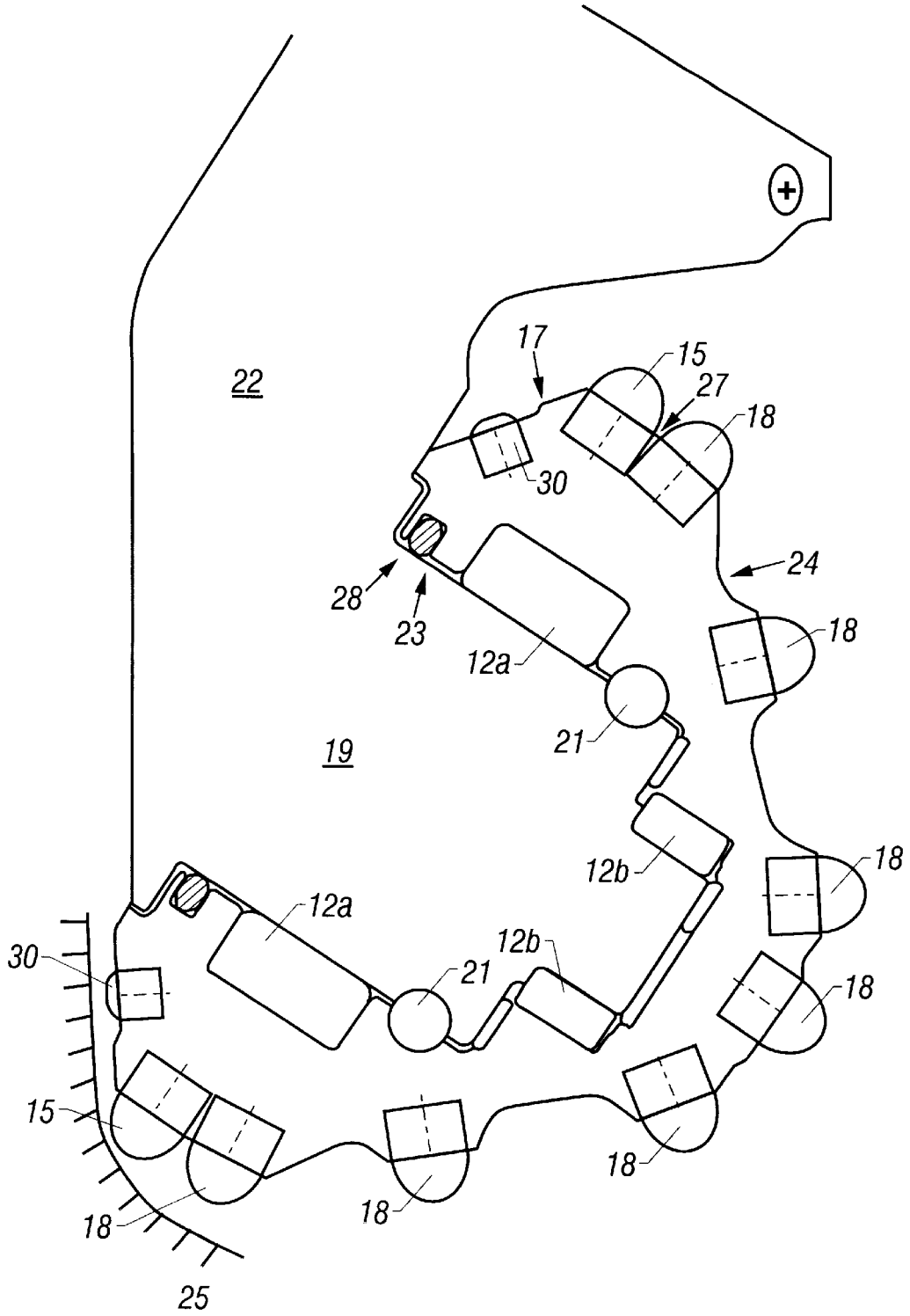
FIG. 2 (Prior Art)
FIG. 2 is a cross-sectional view of a prior art cone at the bottom of a borehole.

When in use, the rock bit is threaded onto the lower end of a drill string (not shown) and lowered into a well or borehole. The drill string is rotated by a rig rotary table with the carbide inserts in the cones engaging the bottom and side of the borehole 25 as shown in FIG. 2. As the bit rotates, the cones 16 rotate on the bearing journals 19 and essentially roll around the bottom of the borehole 25. The weight on the bit is applied to the rock formation by the inserts 18 and the rock is crushed and chipped by the inserts. A drilling fluid is pumped through the drill string to the bit and is ejected through nozzles 26 (shown in FIG. 1). The drilling fluid then travels up the annulus formed between the exterior of the drill pipe and the borehole 25 wall, carrying with it most of the cuttings and chips. In addition, the drilling fluid serves to cool and clean the cutting end of the bit as it works in the borehole 25.

FIG. 2 shows the lower portion of the leg 22 which supports a journal bearing 19. A plurality of cone retention balls ("locking balls") 21 and roller bearings 12*a* and 12*b* surround the journal 19. An O-ring 28, located within in an O-ring groove 23, seals the bearing assembly.

The cone includes multiple rows of inserts, and has a heel portion 17 located between the gage row inserts 15 and the O-ring groove 23. A plurality of protruding heel row inserts 30 are about equally spaced around the heel 17. The heel row inserts 30 and the gage row inserts 15 act together to cut the gage diameter of the borehole 25. The inner row inserts 18 generally are arranged in concentric rows and they serve to crush and chip the earthen formation.

As used herein, the term "erosion" will be used to refer to both erosion and other abrasive wear. Much of the erosion of the cone body typically occurs between the gage row inserts 15 and heel row inserts 30. Furthermore, erosion also may occur at the lands 27 between the gage row inserts 15 and inner row inserts 18. Generally, a "land" refers to a surface on a rolling cone where insert holes are drilled on the cone. It is also possible that erosion may occur in the grooves 24 between successive inner row inserts 18. These areas on a rolling cone surface are collectively referred to as "areas susceptible to erosion." Erosion in these areas may result in damage to the cone, loss of the inserts and/or cone cracking that particularly occurs between the inserts. In highly erosive environments, the whole cone body may be subjected to severe erosion and corrosion.

Some of the present embodiments provide rock bits with hardfacing coating in the cone areas susceptible to erosion. The "hardfacing" is applied according to the following steps: (1) determining the areas susceptible to erosion on the cone surface when the rock bit is in use; (2) depositing a layer of hard-facing material by an arc process in the areas susceptible to erosion; (3) heat treating the cone after the deposition of hardfacing material; (4) drilling sockets for receiving inserts on the conical surface in areas that are substantially away from the areas overlaid with a layer of hardfacing material; and (5) press inserts into the sockets on the rolling cone. Here, "substantially away" means a separation of at least 1/16 inch. Optionally, the cone may be annealed before the hardfacing material is deposited. This annealing step may reduce crack initiation in the cone surface area affected by heat during the hardfacing process.

Figure 3:
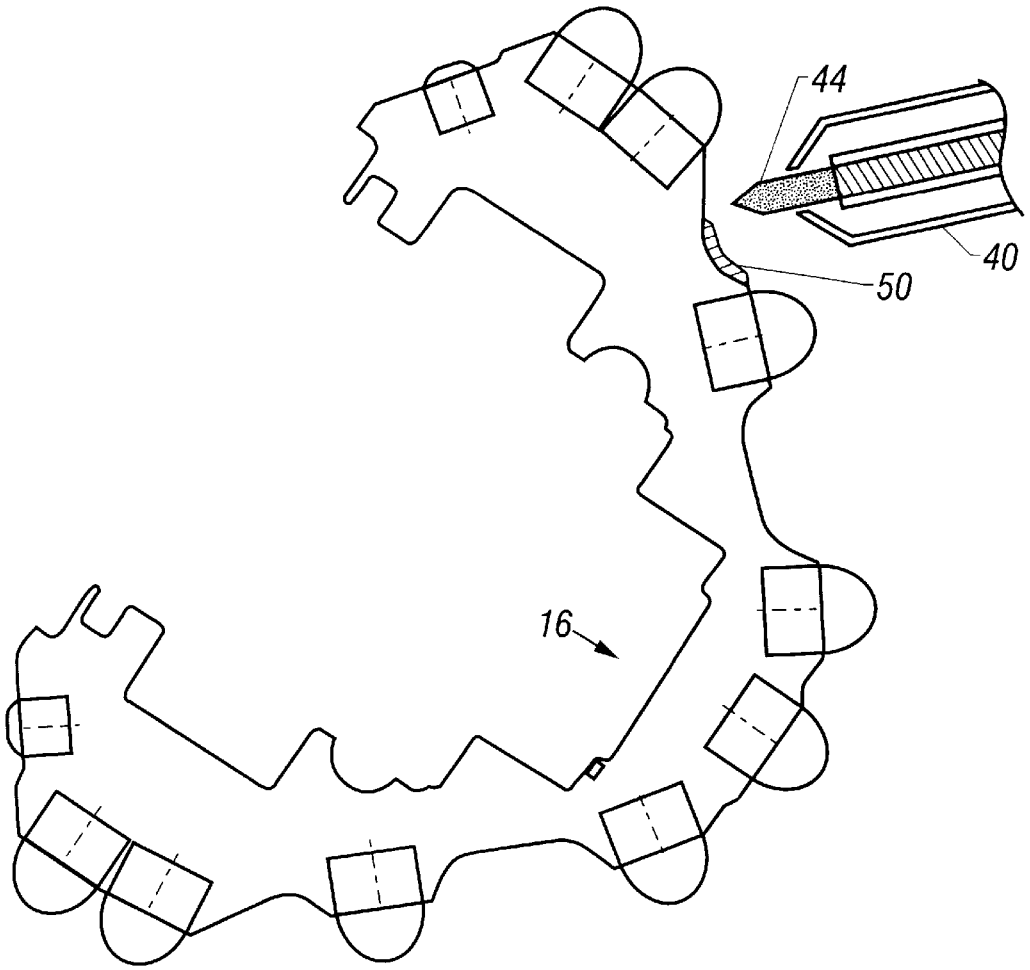
FIG. 3 is a cross-sectional view of a cone undergoing a hardfacing process according to one embodiment.

In some embodiments, the location and arrangement of inserts may be determined first. Afterwards, areas which are susceptible to erosion on the cone surface are determined. As illustrated in FIG. 3, a layer of hardfacing material is then deposited on the identified area. FIG. 3 shows a cone 16 before insert-receiving holes are drilled and inserts are press-fitted therein. The intended location of the inserts are represented by dotted lines. An arc torch 40 is generally placed at a predetermined distance from the surface of the cone. A layer of hardfacing material 50 is contained within and deposited by an arc flame 44. The torch 40 may be moved along the surface of the rolling cone to deposit the layer of hardfacing material in all of the desired areas. After areas susceptible to cone erosion have been overlaid, the cone is heat treated according to methods well known in the art. After heat treatment, holes or sockets are drilled in the predetermined locations on the cone and the inserts are press-fitted into the sockets.

Figure 4:
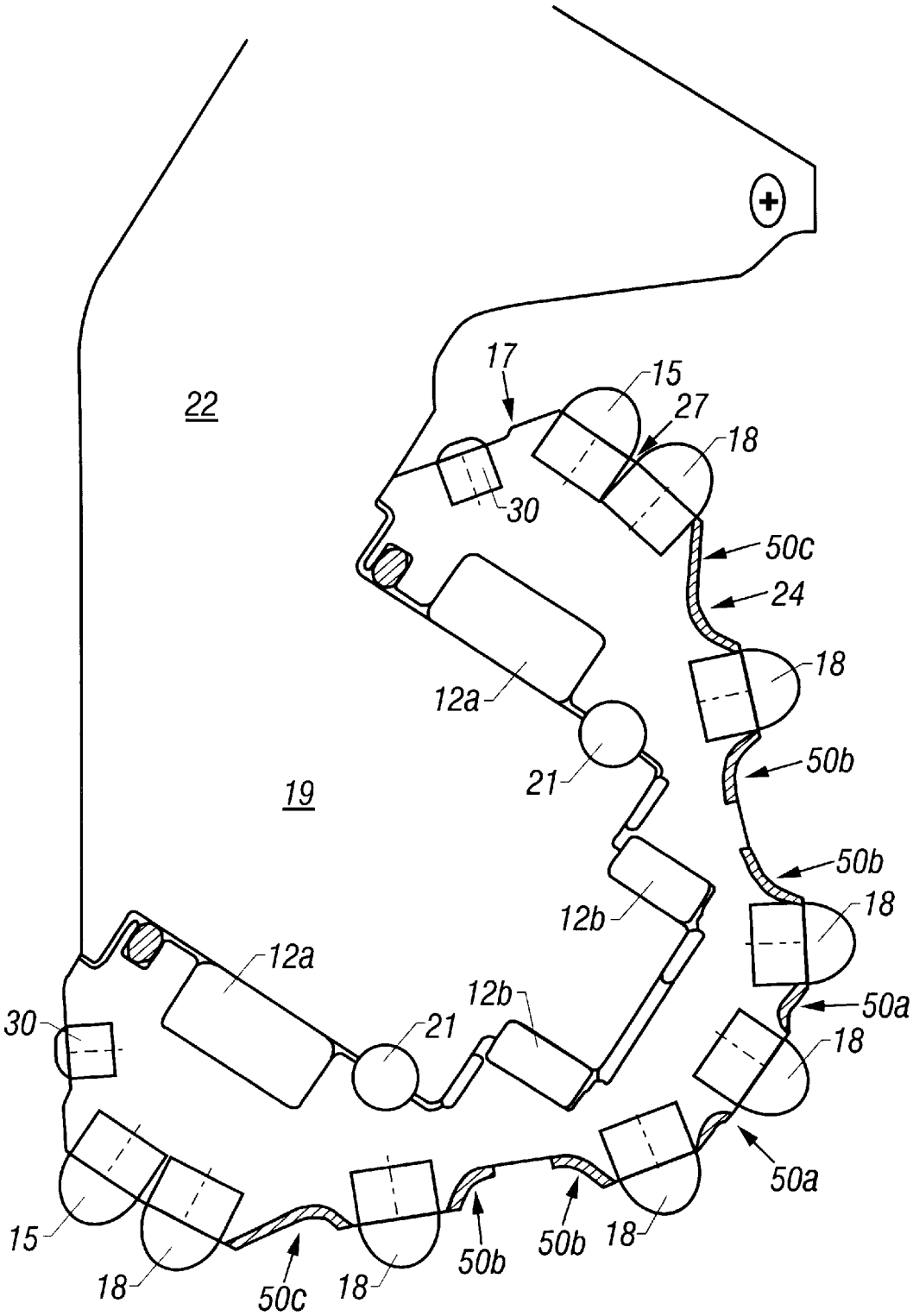
FIG. 4 is a cross-section of a cone with hardfacing material applied to the surface of the cone according to another embodiment.

After the manufacture of cone 16 is completed, the cone is mounted on journal 19 as illustrated in FIG. 4. A layer of hardfacing material is shown deposited in different areas of the cone 50*a*, 50*b*, and 50*c* that are prone to erosion. The layers 50*a*, 50*b* and 50*c* may be of the same or different hardfacing materials, depending upon the application of the rock bit.

Figure 5:
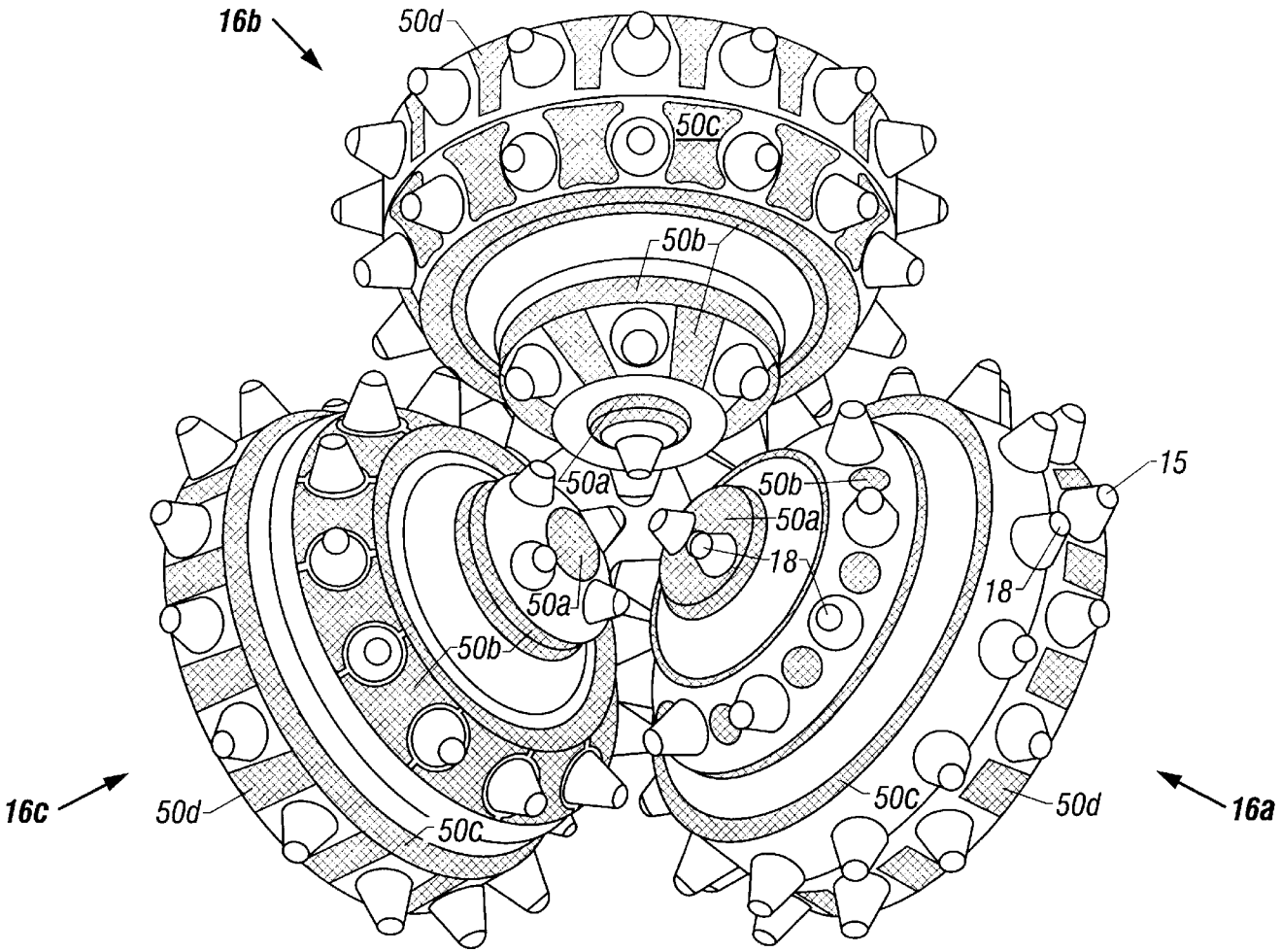
FIG. 5 is an isometric view of a rock bit with three cones overlaid with hardfacing material according to still another embodiment.

FIG. 5 shows a rock bit with three cones 16*a*, 16*b*, and 16*c* overlaid with hardfacing material according to another embodiment. Although the insert configuration on one cone is different from that of other cones in FIG. 5, it is entirely acceptable to manufacture a rock bit with three identical cones. This figure indicates that additional hardfacing layer 50*d* may be deposited in the lands 27 between gage row inserts 15. It should be understood that the shape of the hardfacing layer 50 is not critical so long as the boundary of the hardfacing layer is substantially away from the inserts 15 and 18. Consequently, various shapes of hardfacing are possible, including, but are not limited to: rounded, circular, elliptical, square, rectangular, trapezoidal, oblong, arched, triangular, annular, or any other suitable regular or irregular shape. A layer of hardfacing material also may be deposited in the grooves of the rolling cone as a continuous circumferential ring.

In a typical rock bit, the nose of a cone is situated close to the nose of one or more other cones. As a result, there is limited clearance between the noses. To avoid an undesirable reduction in the clearance between the noses, it may be desirable to make a groove or recess in the areas susceptible to erosion at the nose of the rolling cone. As shown in FIG. 4, a layer of hardfacing material 50*a* is deposited in the groove so that the hardfacing material is substantially flush with the surface of the cone. In this way, the nose area of the rolling cone is protected from erosion without sacrificing clearance between the noses of the rolling cones. It should be understood that the use of a groove as shown in this embodiment may be practiced in other suitable areas of the cone surface, and is not necessarily limited to the nose region of a cone.

Figure 6:
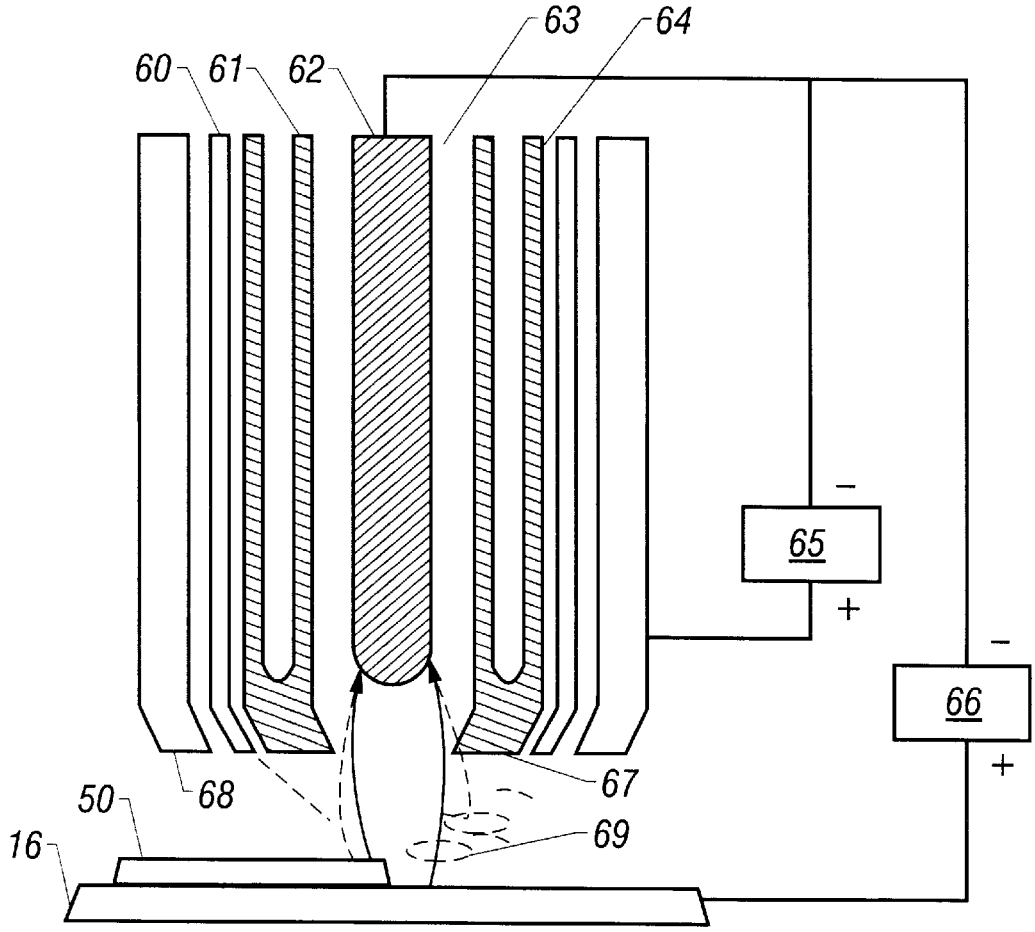
FIG. 6 is a schematic of a plasma transferred arc process in accordance with an embodiment.

Hardfacing material may be deposited by an arc process that is known in the art. Here, an "arc process" refers to a hardfacing process that utilizes an arc between an electrode and a work piece to be hardfaced. One method is the plasma transferred arc (PTA) welding process. As shown in FIG. 6, the PTA welding process uses a torch similar to a conventional plasma arc torch with an electrode grounded to the work piece. A PTA system generally includes two power supplies: a pilot arc power supply 65 and a transferred arc power supply 66. In a PTA welding process, a pilot plasma arc is initiated between a tungsten or tungsten-thorium electrode 62 and a copper orifice 67 with a water-cooled electrode 61. An inert gas 63, such as argon, flowing through the orifice is ionized so that it initiates a secondary arc between the tungsten electrode 62 and the work piece (i.e., cone) 16 when the current is increased. The arc and the weld zone are shielded by a gas 60 flowing through an outer nozzle 68. The shielding gas may include argon, helium or mixtures of inert gases. The plasma created by the arc current may be further collimated by nozzle 68 and then expanded and accelerated towards the work piece. Hardfacing powder 69 of a suitable composition is injected into the plasma column by a carrier gas 64 such as argon, helium, or mixtures of inert gases, through powder-feeding ports in the nozzle 68 onto the work piece. A molten pool forms on the work piece in the arc transfer region that is protected from oxidation or contamination by the shielding gas. Fusion occurs between the deposited powder and the work piece. Direct heating from the plasma provides high density hardfacing which is metallurgically bonded to the work piece. Typical coating conditions are as follows: the arc voltage and current are in the range of about 20–40 volts and about 60–200 amps; the shielding gas flow rates are in the range of about 15–40 standard cubic feet per hour ("SCFH"), and powder feed rates are about 20–150 grams per minute.

Generally, substrate dilution is about 5% to 15% for hardfacing coatings deposited by a PTA process. "Substrate dilution" is defined as the weight percentage of the substrate metal which has diffused into the binder matrix. Generally speaking, the lower substrate dilution indicates better hardfacing coatings. It should be understood that powder injection is only one way of introducing the hardfacing material into the plasma stream. Any method known in the art is acceptable. For example, an alternative method involves feeding a tube rod of tungsten carbide (approximately 50% by volume and the balance being carbon steel) into the plasma stream, either by hand or by a mechanical process.

Figure 7:
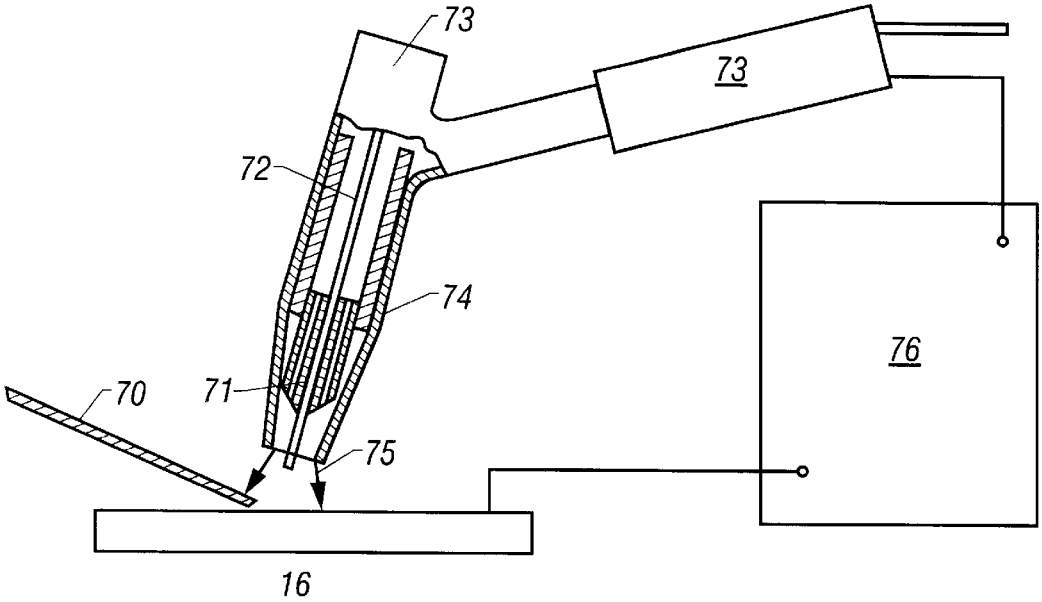
FIG. 7 is a schematic of a gas-shielding tungsten arc process in accordance with an embodiment.

Another acceptable method of applying hardfacing material onto the surface of a cone for erosion protection is the use of a gas-shielding tungsten arc (also known as "gas tungsten arc") welding process as illustrated in FIG. 7. In this process, an arc is established between a tungsten or tungsten-thorium electrode 72 and a work piece (i.e., cone) 16 which is grounded through welding machine 76. The arc forms a welding pool on the work piece. A hard-facing material in the form of a tube rod 70, which contains approximately 50% tungsten carbide by volume, is fed into the weld pool. The rod 70 is fed either by hand or by a machine. The tungsten electrode 72 is non-consumable. To prevent oxidation and contamination, the heated weld zone, the molten metal and the non-consumable electrode which carries the welding current, are shielded from the ambient atmosphere. They are shielded by an inert gas stream 75 which is directed from the electrode holder 73 through a gas passage 71 to the work piece (i.e., cone) 16. The electrode holder 73 has an electrical conductor that connects the power supply of welding machine 76 to the electrode 72. The electrode holder 73 also includes an insulation sheath 74. The inert shielding gas may include argon, helium or mixtures of these gases. Fusion between the hardfacing material and the cone surface is created by the intense heat of the arc. This heat metallurgically bonds the high density hardfacing material to the work piece. Substrate dilution in this process is generally in the range of about 10% to 20%. The gas-shielding tungsten arc welding process can produce a layer of hardfacing material with a thickness greater than 0.030 inch. Typical coating conditions are as follows: the voltage is about 10–20 volts; the current is about 60–100 amps; and the shielding gas flow rates are in the range of 20–30 SCFH.

Figure 8:
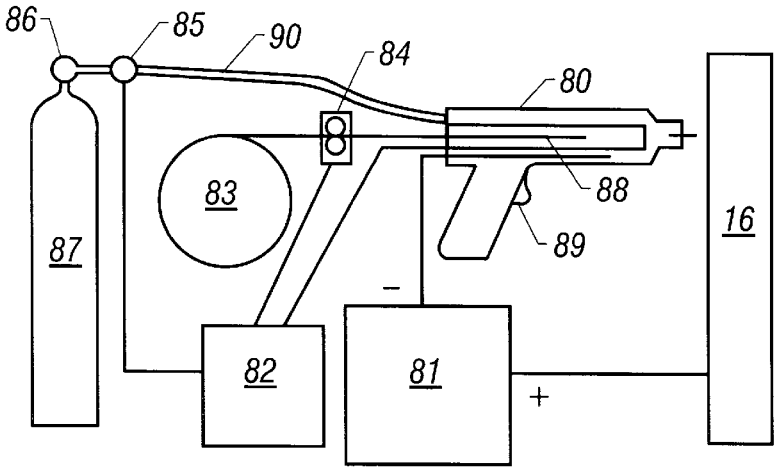
FIG. 8 is a schematic of a metal-inert gas arc welding process in accordance with an embodiment.

Still another alternative method of applying hard-facing material onto the surface of a cone is the metal inert gas arc ("gas metal arc") welding process which is illustrated in FIG. 8. In a typical metal inert gas arc system, a welding gun 80 is connected to a power source 81, a control unit 82, and a gas-delivery tubing 90. The welding gun 80 includes a wire 88 which is supplied by a wire reel 83 through wire drive rolls 84. The positive terminal of power source 81 is connected to a work piece (i.e. cone) 16, and the negative terminal of power source 81 is connected to the wire 88 so that an electrical arc (not shown) is generated by passing electrical current between the wire and the work piece. The arc melts the tip of the wire 88, and droplets of the molten wire are subsequently transferred to the surface of the work piece. Contamination of the weld pool by air is prevented by an inert shielding gas 87 which is delivered to the welding gun through the gas-delivery tubing 90. The flow rate of the shielding gas is monitored and controlled by a flow meter 85 and a valve 86. The shielding gas may include any inert gas such as argon, helium, or any mixtures of these gases. In operation, a small-diameter wire 88 is fed from the wire reel 83 to the welding gun 80. The gun 80 has a trigger 89 which operates the wire drive rolls 84, the power supply 81 and the flow of the shielding gas 87. In cases where it is not possible to fabricate flexible wire with a sufficient volume content of tungsten carbide, a straight tube rod could be fed into the welding gun. This feeding process could be manual or mechanized.

There are four modes of metal transfer in a metal inert gas arc welding process: (1) short circuiting (i.e., dip transfer); (2) globular transfer; (3) spray transfer; and (4) pulsed transfer. In short circuiting (i.e., dip transfer), droplets of molten wire are transferred from the tip of the wire to the work piece by frequently short circuiting the wire to the weld pool with a low current and voltage. This mode of transfer utilizes low heat input which results in a small controllable weld pool. Globular transfer uses somewhat higher currents and voltages than are used for dip transfer. Under this method, metal transfer still occurs by short circuiting the wire to the weld pool. However, spray transfer occurs when the current and voltage are high enough to create free flight of metal droplets with no short circuiting. This provides maximum transfer rates and deep penetration. In pulsed transfer, molten metal droplets are transferred to the surface of the work piece by pulsing the current between a background current and a high pulse current. Typically, the background current is sufficient to sustain the arc but insufficient for substantial metal transfer. However, the high pulse current is set above a threshold level to produce sufficient electromagnetic force for each pulse to transfer one metal droplet from the tip of the wire to the surface of the work piece. As the current is pulsed between the low background current and the high pulse current, the metal droplets are transferred to the work piece successively. Although any pulse frequency may be used, it is preferred that the pulse rate is approximately 50 Hz. Although all four of these modes of metal transfer can be used to deposit hardfacing material on rock bit cones, the pulsed transfer mode is preferred because it provides a higher deposition rate with minimal heat generation and thus results in a higher volume content of tungsten carbide in the hardfacing coating.

The thickness of the hardfacing material applied to the surface of the cone is generally greater than 0.020 inch, although a preferred thickness is in the range of 0.030 to 0.060 inch. It should, however, be understood that hardfacing coatings with less than 0.020 inch in thickness are also capable of erosion protection, albeit with less efficacy.

As mentioned above, after the hardfacing material is applied to the cone surface, the cone is heat treated before insert sockets or holes are drilled. This step of heat treatment provides stronger metallurgical bonding which reduces the likelihood of chipping and flaking off during operation. Following the heat treatment, the cone insert holes are drilled and the inserts are pressed into the holes and retained with a press-interference fit.

Figure 9:
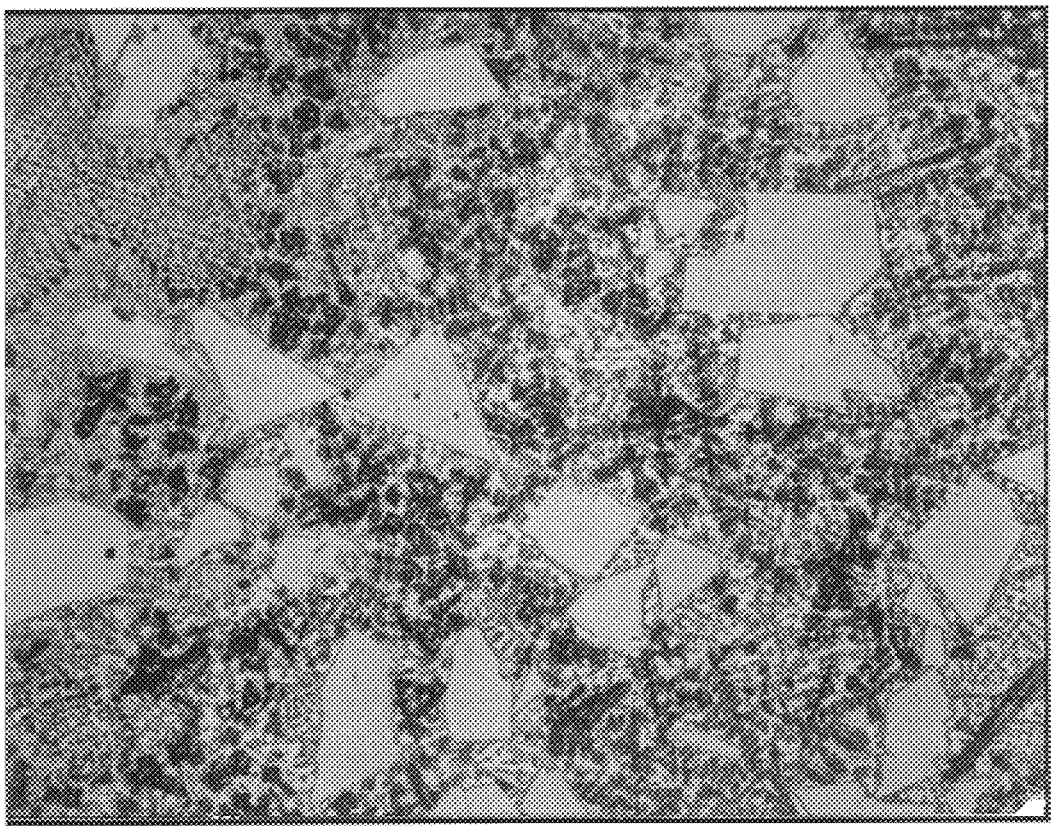
FIG. 9 is a photomicrograph at 160 magnification of the hardfacing material according to another embodiment utilizing the gas-shielding tungsten arc welding process.

The hardfacing material used in embodiments of the invention generally includes a metallic component and a nonmetallic component. The metallic component can be any metal or metal alloys, such as iron, steel, nickel-based alloys, and the like. The nonmetallic component generally includes a hard material, such as carbide, boride, and/or nitride. The hardfacing material may be in the form of powder or tube rod, although other forms also are acceptable. The hardfacing material has specific properties after it has been deposited onto the cone surface. First, the material is segregated into two phases (e.g., a carbide phase and a continuous binder matrix). This is confirmed by photomicrographs of the deposited hardfacing material. FIG. 9 is photomicrographs at 160× magnification of a layer of hardfacing material according to one embodiment using the gas-shielding tungsten arc welding process. The photomicrographs clearly show a particulate phase dispersed in a continuous matrix. Analysis revealed that the particles are the carbide phase and the continuous matrix is the binder matrix.

The volume content of the carbide phase is generally in the range of about 25–60%, with a preferred range of about 35–50%, of the hardfacing material. The carbide phase includes a primary carbide and optionally a secondary carbide. The primary carbide content falls within the range of about 85–95% by volume of the carbide phase. The primary carbide includes single crystal WC, eutectic $WC/W_2C$, sintered WC/Co, or their combinations. On the other hand, the secondary carbide, which is optional, is the balance of the carbide phase; it is generally in the range of about 5–15% by volume of the carbide phase. The secondary carbide phase includes the following materials: VC, TiC, $Cr_3C_2$, $Cr_7C_3$, $Cr_{23}C_6$ or combinations thereof. As indicated in FIG. 9, the shape of the carbide phase may be angular, irregular, rounded, or spherical. The size of the carbide phase generally is within the range of about 15–500 $\mu$m, with a preferred range of about 30–200 $\mu$m.

The volume content of the binder matrix, being the balance of the hardfacing material, generally is in the range of about 35–75% of the hardfacing material. The binder matrix includes a metallic matrix and non-metallic composition. The metallic matrix may contain cobalt, nickel, iron, or mixtures or alloys thereof. It may further include silicon, aluminum, boron, and/or a small amount of refractory metals (such as tungsten, molybdenum, tantalum or other transition metals). The nonmetallic composition includes a secondary carbide and a boride. The total volume content of these materials is between about 7–42%, with a preferred range of about 8–30%, in the binder matrix. The secondary carbides may include VC, TiC, $Cr_3C_2$, $Cr_7C_3$, $Cr_{23}C_6$ or combinations thereof. The borides include CrB, $TiB_2$, $ZrB_2$, or combinations thereof. The particle size of the secondary carbides and the borides is between about 10–50 $\mu$m. The shape of the particles may be angular, irregular, rounded or spherical. Moreover, the non-metallic composition may further include an Eta phase or a trace amount of oxides which are a by-product of the welding process. Eta phase is a phase of carbides of the formula $W_3M_3C$ or $W_6M_6C$, where M is Fe, Co, or Ni. The particle size of the Eta phase is generally less than 20 $\mu$m, and the particle shape can be crystal-like, irregular, or dendritic.

Some embodiments concern automating the placement of hardfacing material onto the cone surfaces. This is particularly important when hardfacing material is applied to the cone surfaces in intricate patterns between the inserts. It is critical that deposition of the hardfacing material not interfere with the subsequent insert hole-drilling operation. One method of automation is to use numerically controlled ("NC") or computer numerically controlled ("CNC") machines to place the hardfacing material directly onto predetermined areas of a rolling cone which are susceptible to erosion. The machines can be programmed using any conventional computer-aided manufacturing techniques to place the hardfacing material sufficiently away from where the insert holes will be drilled. After the cone has been heat treated, the insert holes may be drilled with NC or CNC machines. This will ensure consistency of hole and hardfacing coating locations.

If a hardfacing material is placed on the cone lands between insert holes, a start mark on the cone may be necessary to ensure proper setup for the hole-drilling process to be synchronized with the hardfacing material deposition process. Other suitable methods to ensure a proper zero or circumferential starting location may also be used. For example, a small start hole in the cone which interfaces with a tooling fixture zero point is one possible method. Another acceptable method is to use a machine with index plates that are timed in phase with the subsequent hole-drilling operation. The machine is set up to place hardfacing material onto the cone surface and automatically index to the next circumferential location. This allows insert holes to be drilled in the intended areas. A start mark is also necessary for proper setup of the hole-drilling operation.

In some embodiments, only circumferential bands of hardfacing material are deposited in the cone grooves adjacent to the insert lands. It is entirely possible to do this by a robot. Manufacturing parameters such as speed and feed rate may be optimized to achieve the desired hardfacing thickness and consistency.

Figure 10:
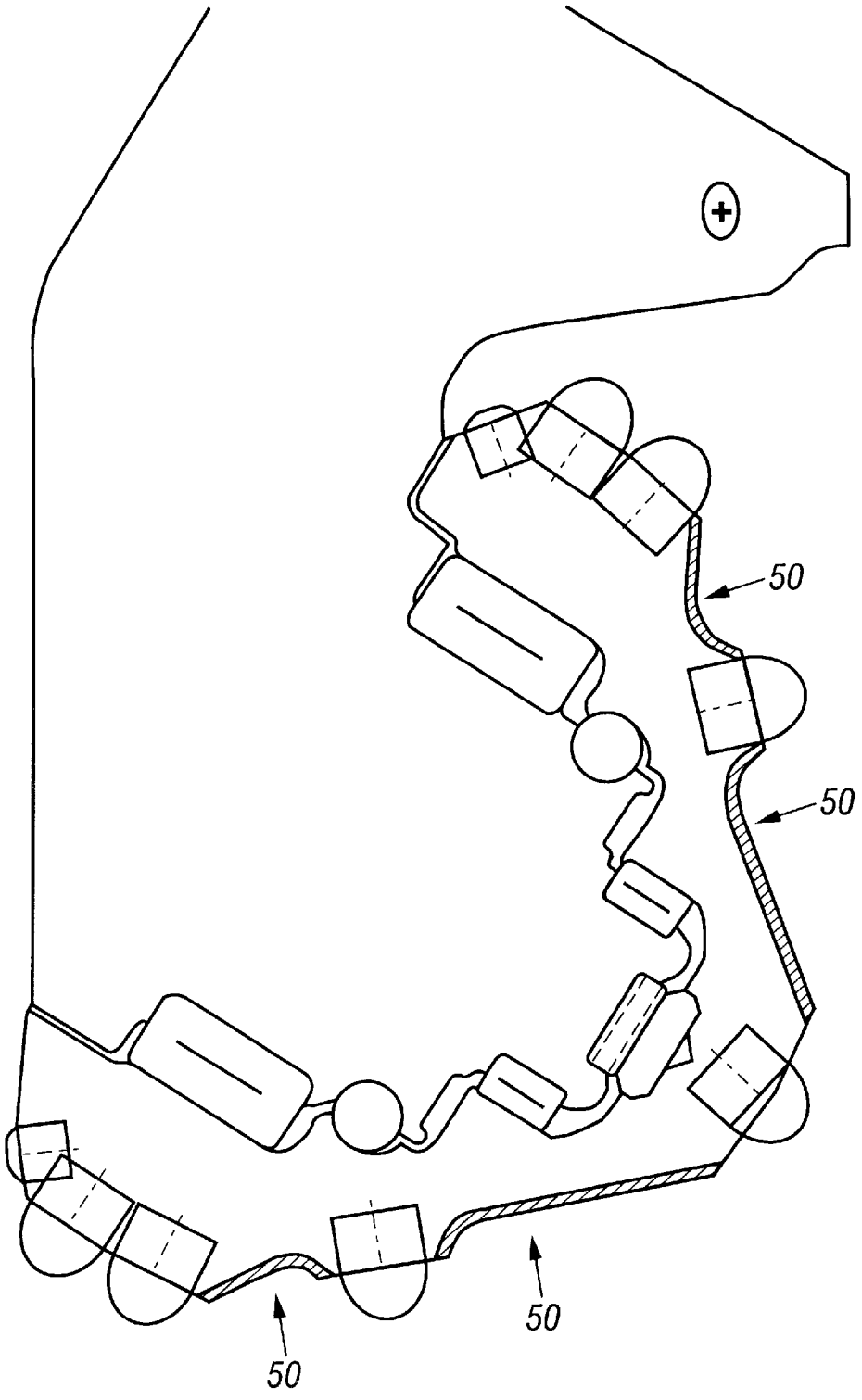
FIG. 10 is a cross-sectional view of a cone in a 7⅞ inch mining rock bit coated with hardfacing material according to one embodiment.

To test erosion resistance of rock bit cones coated with the hardfacing material according to the present embodiments, numerous 7⅞ inch mining rock bits with the hardfacing material applied to the cone grooves were tested in a coal mine. For example, FIG. 10 illustrates a mining rock bit cone that was coated with hardfacing material in the grooves of the cone by the gas-shielding tungsten arc welding process. The process parameters used to hardface the cone are as follows: argon gas flow rate of 25 cubic feet per hour, 7/16 inch diameter gas cup, ⅛ inch diameter 2% thoriated tungsten electrode, current of 60 to 80 amps, and voltage of 10 to 12 volts. A tube rod designated as "ST-70 M" was fed into the arc by hand. The 70 M tube rod contained about 65% by weight of macro-crystalline WC with particle size in the range of about 75 to 177 $\mu$m and 35% by weight of steel of the AISI 1018 type. The hardfacing coating had a thickness of approximately 0.060 inch and contained approximately 32% of tungsten carbide by volume as the primary carbide. The primary tungsten carbide particles were in the range of 25 to 200 $\mu$m with the most common size being approximately 175 $\mu$m. The microstructure of the hardfacing coating showed that the tungsten carbide particles were rounded.

The hardfaced mining rock bits were tested with regular mining rock bits of identical size. Without the hardfacing material, the regular mining bits manifested the primary failure mode—premature loss of the interior inserts near the nose or the apex of the cone. The hard-faced mining rock bits, on the other hand, manifested a significant improvement in cone erosion. Furthermore, premature loss of inserts was virtually eliminated in the case of hardfaced mining rock bits.

As demonstrated above, the present embodiments are capable of producing highly erosion-resistant hardfacing coatings on rock bit cone surfaces to prevent cone shell erosion during operation. The processes employed by the embodiments are easy to implement and cost-effective. Furthermore, the coating thickness, uniformity, porosity and oxide build-up are easier to control than previous methods. Equally important, the present embodiments provide a hardfacing coating with strong metallurgical bonding between the hardfacing material and the rolling cone surfaces. This strong metallurgical bonding makes the hardfacing material less likely to chip or flake off during operation. As a result, premature loss of inserts may be virtually eliminated during normal operation.

While the invention has been disclosed with respect to a number of embodiments, those skilled in the art will appreciate numerous modifications and variations therefrom. For example, although the hardfacing coatings are described in reference to protection of cone erosion in petroleum bits and mining bits, it should be further understood that the invention is equally applicable to other earth-boring devices with rotating elements which experience cone erosion. It should be understood that the invention is applicable to a rock bit with any bearing configuration system, such as friction bearings, sealed bearings, open bearings and the like. Although it is desirable to coat a hardfacing material in both the lands and the grooves of a rolling cone surface, it is not always necessary to do so. In some applications, coating either the lands or the grooves alone is sufficient to protect the cone shell from erosion. As to the composition of the primary carbide, it is preferred that the primary carbide include one or more of single-crystal WC, eutectic $WC/W_2C$, and sintered WC/Co. It should be understood that any hard carbide may be used in place of single-crystal WC, eutectic $WC/W_2C$, and sintered WC/Co. Such carbides may include, for example, titanium carbide or chromium carbide. Furthermore, it is also conceivable that a third carbide phase may be beneficial to cone erosion protection. Such a ternary carbide may include any hard carbide materials. Finally, although it is preferred that the hardfacing step occurs before inserts are pressed into the sockets, the invention can be practiced in any other order.

While the invention has been disclosed with reference to specific examples of embodiments, numerous variations and modifications are possible. Therefore, it is intended that the invention not be limited by the description in the specification, but rather the claims that follow.

What is claimed is:

1. A cone or attachment to a rock bit comprising:

a generally conical body, a section of a surface thereon being susceptible to erosion;

a layer of hardfacing material that is deposited by an arc process on the erosion-susceptible section of the surface, the arc process including the cone as an arc electrode;

a plurality of sockets drilled into the body; and an insert disposed in each of the plurality of sockets.

2. The cone of claim 1, wherein the layer of hardfacing material is flush with an adjacent surface of the conical body.

3. The cone of claim 1, wherein each of the sockets are separated from the layer of hardfacing material by at least 1/16 of an inch.

4. The cone of claim 1, wherein the layer of hardfacing material has a thickness greater than 0.02 inches.

5. The cone of claim 1, wherein the layer of hardfacing material has a thickness between 0.03 inches and 0.06 inches.

6. The cone of claim 1, wherein the hardfacing material comprises:

a carbide phase; and a continuous binder matrix.

7. The cone of claim 6, wherein the carbide phase comprises a primary carbide selected from the group of: single-crystal WC, eutectic $WC/W_2C$, and sintered WC/Co.

8. The cone of claim 7, wherein the carbide phase further comprises a secondary carbide selected from the group consisting of: VC, TiC, $Cr_3C_2$, $Cr_7C_3$, and $Cr_{23}C_6$.

9. The cone of claim 7, wherein the continuous binder matrix comprises:

a metallic matrix selected from the group consisting of: cobalt, nickel, and iron; and a non-metallic composition comprising a carbide selected from the group of: VC, TiC, $Cr_3C_2$, $Cr_7C_3$, and $Cr_{23}C_6$, and a boride selected from the group of: CrB, $TiB_2$, and $ZrB_2$.

10. A cone for attachment to a rock bit comprising:

a generally conical body, a section of a surface thereon being susceptible to erosion;

a layer of hardfacing material deposited by an automated arc process in a selected pattern on the erosion-susceptible section of the surface, the arc process including the cone as an arc electrode;

a plurality of sockets drilled into the body; and an insert that is disposed in each of the plurality of sockets.

11. The cone of claim 10, wherein the automated arc process is computer controlled.

12. The cone of claim 10, wherein the automated arc process is numerically controlled.

13. The cone of claim 10, wherein the layer of hardfacing material has a thickness greater than 0.02 inches.

14. The cone of claim 10, wherein the layer of hardfacing material has a thickness between 0.03 inches and 0.06 inches.

15. The cone of claim 10, wherein the hardfacing material comprises:

a carbide phase; and a continuous binder matrix.

16. The cone of claim 15, wherein the carbide phase comprises a primary carbide selected from the group of: single-crystal WC, eutectic $WC/W_2C$, and sintered WC/Co.

17. The cone of claim 16, wherein the carbide phase further comprises a secondary carbide selected from the group consisting of: VC, TiC, $Cr_3C_2$, $Cr_7C_3$, and $Cr_{23}C_6$.

18. The cone of claim 17, wherein the continuous binder matrix comprises:

a metallic matrix selected from the group consisting of: cobalt, nickel, and iron; and a non-metallic composition comprising a carbide selected from the group of: VC, TiC, $Cr_3C_2$, $Cr_7C_3$, and $Cr_{23}C_6$, and a boride selected from the group of: CrB, $TiB_2$, and $ZrB_2$.

19. A cone for attachment to a rock bit comprising:

a generally conical body, a section of a surface thereon being susceptible to erosion, the body including at least one reference mark thereon for indexing an arc welding machine to a drilling machine;

a layer of hardfacing material that is deposited by an automated welding process in a selected pattern on the erosion-susceptible section of the surface;

a plurality of sockets drilled into the body; and an insert disposed in each of the plurality of sockets.

20. The cone of claim 19, wherein the welding process is numerically controlled.

21. The cone of claim 19, wherein the welding process is computer controlled.

22. The cone of claim 19, wherein the layer of hardfacing material has a thickness greater than 0.02 inches.

23. The cone of claim 19, wherein the layer of hardfacing material has a thickness between 0.03 inches and 0.06 inches.

24. The cone of claim 19, wherein the hardfacing material comprises:

a carbide phase; and a continuous binder matrix.

25. The cone of claim 24, wherein the carbide phase comprises a primary carbide selected from the group of: single-crystal WC, eutectic $WC/W_2C$, and sintered WC/Co.

26. The cone of claim 25, wherein the carbide phase further comprises a secondary carbide selected from the group consisting of: VC, TiC, $Cr_3C_2$, $Cr_7C_3$, and $Cr_{23}C_6$.

27. The cone of claim 26, wherein the continuous binder matrix comprises:

a metallic matrix selected from the group consisting of: cobalt, nickel, and iron; and a non-metallic composition comprising a carbide selected from the group of: VC, TiC, $Cr_3C_2$, $Cr_7C_3$, and $Cr_{23}C_6$, and a boride selected from the group of: CrB, $TiB_2$, and $ZrB_2$.

28. The cone of claim 19 wherein the welding process comprises an arc process wherein the cone is an arc electrode.

* * * * *